US005183251A

United States Patent [19]

Sardella

[11] Patent Number: 5,183,251

[45] Date of Patent: Feb. 2, 1993

[54] CONVEYOR SYSTEM AND FEEDING SHEETS

[76] Inventor: Louis M. Sardella, 19 Pickburn Ct., Hunt Valley, Md. 21030

[21] Appl. No.: 548,252

[22] Filed: Jul. 5, 1990

Related U.S. Application Data

[63] Continuation-in-part of Ser. No. 257,063, Oct. 13, 1988.

[51] Int. Cl.[5] ..... B65H 5/02; B65H 5/06

[52] U.S. Cl. ..... 271/276; 271/195

[58] Field of Search ..... 271/97, 98, 112, 276, 271/195-197

[56] References Cited

U.S. PATENT DOCUMENTS

| | | | |
|---|---|---|---|
| 1,193,627 | 8/1916 | Staude . | |
| 3,341,195 | 9/1967 | Brandt et al. . | |
| 3,452,982 | 7/1969 | Bischoff | 271/197 |
| 3,477,558 | 11/1969 | Fleischauer | 271/197 X |
| 3,770,266 | 11/1973 | Wehr | 271/195 X |
| 3,800,432 | 4/1974 | Miyata et al. | 34/151 |
| 3,902,407 | 9/1975 | Trosdorff | 271/276 X |
| 3,941,372 | 3/1976 | Matsuo . | |
| 4,019,731 | 4/1977 | Vits | 271/196 X |
| 4,236,708 | 12/1980 | Matsuo . | |
| 4,237,466 | 12/1980 | Scranton | 346/75 |
| 4,869,166 | 9/1989 | Mathes | 101/230 |
| 5,048,812 | 9/1991 | Holmes | 271/112 X |

FOREIGN PATENT DOCUMENTS

| | | | |
|---|---|---|---|
| 468077 | 11/1928 | Fed. Rep. of Germany | 271/195 |
| 256538 | 2/1928 | Italy | 271/195 |
| 22275 | 2/1977 | Japan | 271/197 |

*Primary Examiner*—Richard A. Schacher
*Attorney, Agent, or Firm*—William E. Mouzavires

[57] ABSTRACT

Registered conveying and feeding of sheets in a box finishing machine by a wheel or endless belt conveyor and positive air pressure provided on the side of the sheet opposite the conveyor to hold the sheet against movement relative to the conveyor. Air flow across the top surface of the sheet is restricted to establish a constant film of pressurized air above the top surface of the blank for securing the blank to the underlying conveyor.

3 Claims, 4 Drawing Sheets

CONVEYOR SYSTEM AND FEEDING SHEETS

RELATED APPLICATION

This application is a continuation-in-part of U.S. application Ser. No. 07/257,063, filed Oct. 13, 1988 and entitled "Method and Apparatus for Feeding Sheets."

BACKGROUND OF INVENTION

The present invention generally relates to conveying or feeding sheets or sheet material such as, for example, corrugated blanks, in a box finishing machine. In such machine it is important that the sheets are fed in synchronism with the operations performed at the stations along the machine, such operations being, for example, printing, slotting and scoring, folding and gluing. In the box finishing machine art, synchronous feeding of the sheets relative to the cycle of operation at the various stations along the machine is often referred to as "register feeding" or "feeding in register". In order for the operations such as printing, slotting, scoring, folding and gluing to be performed at the right locations on the sheet, it is obvious that the sheet must arrive at the stations at precisely the right times.

In a box finishing machine, for example, corrugated blanks are fed from a vertical hopper one by one from beneath the hopper by means of a first feeder which sequentially transports the blanks from the bottom of the hopper to a second feeder positioned at the beginning or inlet of the box finishing machine. In conventional machines, the second feeder may be nip rolls or feed rolls. Downstream of the nip or feed rolls, pull rolls are employed to convey the blanks from one station to the next station. Pull rolls include a bottom roll typically made from steel with a smooth surface, and a plurality of collars above the steel roll and rotating in counter direction, the collars typically having a knurled steeled surface or a rubber surface. The sheets are fed between the collars and the underlying steel roll which then proceed to feed the sheet along the path of the finishing machine.

One of the problems which attends the use of such pull rolls is that they can crush or deform the corrugated board if the gap between the collars and the underlying roll is not precisely set. Crushing of the board of course reduces the strength of the ultimate box product. Deformation of or contact with the board, even slight deformation or contact, is detrimental to printing on the board. Another problem which can be experienced with such pull rolls is that they at times do not sufficiently grip the blanks. In addition when the sheets or blanks being fed are warped, the pull rolls are unable to flatten the sheets or blanks and resulting in loss of register or jams in the feeding. Furthermore when the blanks are received from a printing station, the collars can smear the ink that was just printed.

Another type of feeder known in the box-making industry as feed rolls or nip rolls and which has been used in the industry includes an underlying roll typically having a knurled steel surface and an upper roll having for example a steel core and a grooved rubber surface layer. The sheet or corrugated blank being fed is of course gripped between the rolls and fed along the path of the finishing machine. With such, the sheet or blank being fed is still susceptible to crushing or deformation, and furthermore it will not be gripped with sufficient force if the gap between the rollers is not set to precise dimension. Moreover the precise setting of the gap is not predictable with such rolls. Furthermore like the pull rolls described above, the presently described feed rolls also are unable to flatten warped sheets or blanks resulting in loss of register and jamming. In addition, the deformation of the flexible or deformable feed roll surfaces causes variation in surface speed resulting in loss of register and roll wear. In order to prevent injury to an operator's hands, it is necessary to install a nip guard adjacent to the nip rolls. However nip guards can cause a jam or inhibit feeding of warped blanks.

More recently a vacuum type conveyor has been used in which for example a wheel or belt conveyor is contained in a vacuum box so that the vacuum holds the sheet or blank on the belt or wheels of the conveyer. However, the problem with this method is that if the vacuum in the vacuum box is constant, large air losses occur in the spaces between successive sheets or blanks being fed thus requiring a very large volume of vacuum and vacuum source not to mention the noise that attends such installations.

In an attempt to overcome this problem, application of the vacuum is timed with the flow of the sheets or blanks. However this imposes a limitation on the speed of the feeding process and in turn production while further requiring complicated and expensive mechanisms in order to effect the periodic application of vacuum in timed relationship with the flow of sheets or blanks. In addition, with a vacuum system, the amount of vacuum that can be applied to the sheets is limited and thus loss of register can result.

OBJECTS OF THE PRESENT INVENTION

One of the objects of the present invention is to provide a novel and improved conveyor system for feeding sheets or blanks including without limitation corrugated board in a box finishing machine while at the same time reducing, if not eliminating, the problems mentioned above attendant to conventional feeder systems of the prior art. Although the present invention is particularly suitable for use in feeding sheets or blanks in a box finishing machine, it will be understood that the present invention may have equal applicability for feeding sheets in other environments and for other purposes.

Another object of the present invention is to provide a novel and improved conveyor system and method for feeding sheets or blanks in register in a box finishing machine. Included herein are such method and apparatus which do not rely upon gripping the sheet or blank with counterrotating rolls or collars which must be set to a precise gap for gripping the sheet for feeding in register.

Another object of the present invention is to provide a novel and improved system for feeding sheets and which will also flatten warped sheets so as not to adversely affect the feeding process.

A further object of the present invention is to provide such a novel and improved sheet feeder which will attain the above objects and yet may be incorporated into a conventional box finishing machine to receive sheets from a feeder that feeds the sheets from a hopper.

A still further object is to provide method and apparatus for feeding sheets which will also speed the drying of newly printed ink on the sheets to thereby allow the rate of production to be increased.

SUMMARY OF INVENTION

In summary, the present invention utilizes a conveyor such as a belt conveyor, roll conveyor or wheel conveyor for moving the sheet, and positive fluid pressure applied to the sheet on the side of the sheet opposite the conveyor for holding the sheet on the conveyor. In the preferred embodiment, the positive pressure is applied from a head having one or more outlet orifices and means for establishing a film of fluid such as air between the head and the sheet being fed so that the sheet is properly held on the underlying conveyor and is transported thereby while being spaced from the head. After leaving the orifices the flow of air is restricted enabling the film of air to be established for properly holding the blank against the underlying conveyor for movement therewith and without interference from the head, yet at the same time the flow of air is sufficiently restricted to limit the loss of air when a blank is not present on the conveyor adjacent the orifice. Any suitable fluid pressure such as air pressure is supplied to the head.

DRAWINGS

Other objects and advantages of the present invention will become apparent from the following more detailed description taken in conjunction with the attached drawings in which.

DETAILED DESCRIPTION

Figure 1:
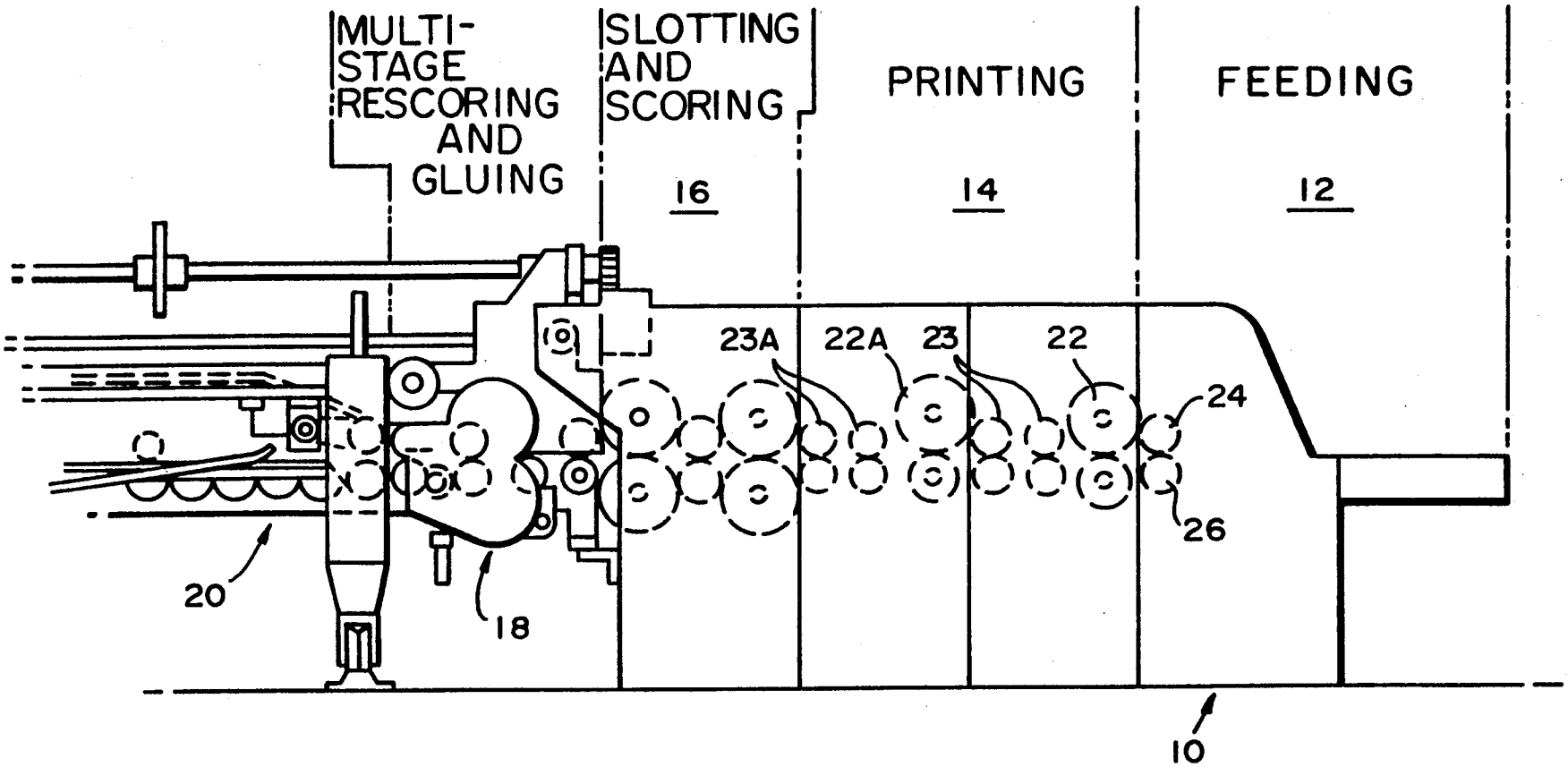
PRIOR ART FIG. 1
FIG. 1 is an elevational view of a box finishing machine of the prior art illustrating the type of machine in which the conveyor system or feeder of the present invention may be applied.

Referring now to the drawings in detail and initially to FIG. 1 there is shown in schematic form a box finishing machine which typically exists in the prior art. Such machine includes at the inlet end 12 a feeding station where sheets or corrugated boards or blanks are fed from a hopper to a pair of nip rolls or feed rolls 24 and 26 as described above under the section BACKGROUND OF INVENTION. The hopper and the feeder which conveys the blanks from the hopper to the rolls 24 and 26 are not shown in FIG. 1, however any suitable feeder may be employed such as for example that shown in U.S. Pat. Nos. 4,045,015, and 4,614,335, Sardella and 3,392,973 and 4,494,745, Ward et al. However, a preferred feeder for feeding sheets from the hopper to the conveyor of the present invention is disclosed in my copending U.S. application Ser. No. 07/257,063 filed Oct. 13, 1988 and entitled "Method and Apparatus for Feeding Sheets." The disclosures of the above-mentioned patents and application are hereby incorporated by reference into the subject application as part hereof.

Referring to FIG. 1, the sheets are fed by rolls 24,26 to a printing station where one or more printing rollers 22 print indicia on the sheet after which the sheet is conveyed by pull rolls 23 to further stations including slotting and scoring station 16 where the sheet is slotted and scored in a predetermined pattern. The sheet is then conveyed to a rescoring and gluing station 18 after which the sheet is conveyed to a folding station 20 where the sheet is folded so that the glue flap along one edge of the sheet is in contact with the opposite edge so as to form a folded paper board, cardboard or corrugated board box. The method and apparatus of the present invention may be used to replace the feed rolls 24 and 26 and/or pull rolls 23 in a box finishing machine such as for example described above in FIG. 1.

Figure 2:
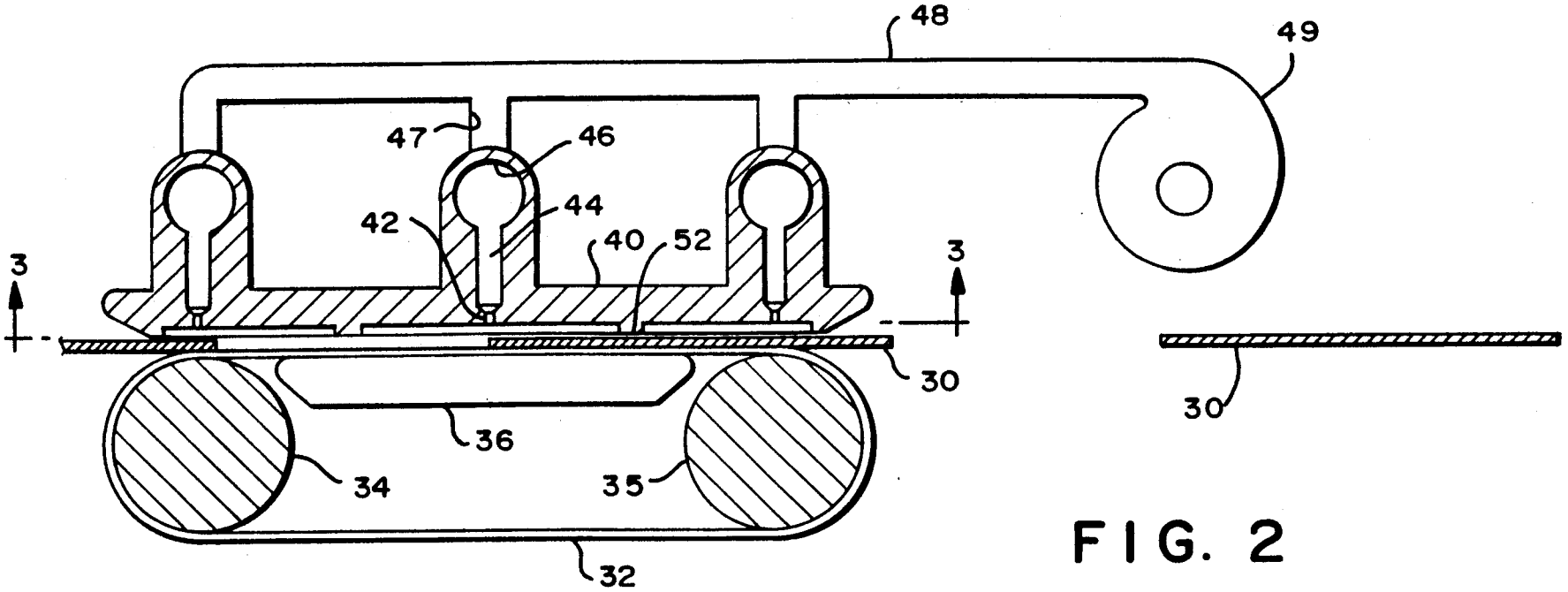
FIG. 2 is a longitudinal cross-sectional view of a feeder constituting one preferred embodiment of the invention.
Figure 3:
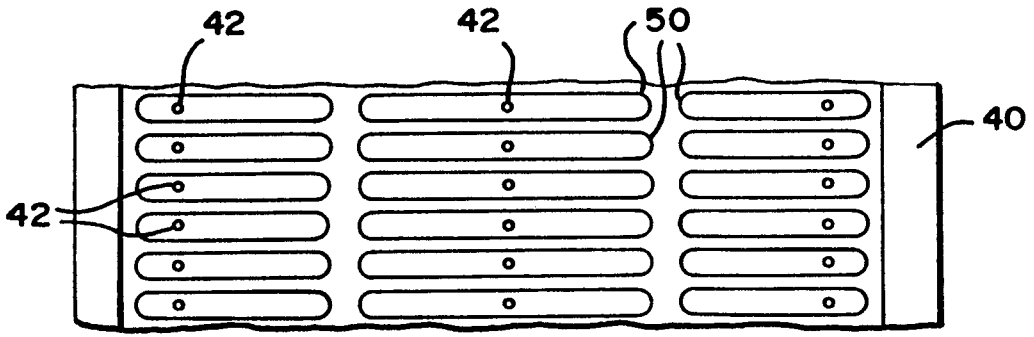
FIG. 3 is a fragmental cross-sectional view taken generally along lines 3—3 of FIG. 2.

Referring now to FIGS. 2 and 3 there is shown one preferred embodiment of a conveyor system or feeder in accordance with the present invention for feeding sheets or corrugated blanks 30 along a horizontal path in a machine such as a box finishing machine described above. The conveyor includes any suitable means for transporting the sheet along the conveyor path, such means being shown as an endless conveyor belt 32 trained about end sprockets or pulleys 34 and 35 with an intermediate horizontal support 36 located below the upper run of the belt 32 to support the same. The conveyor belt 32 has a high friction surface to enhance frictional engagement with the lower surface of the blank 30. Support 36 which supports the upper end of belt 32 however is provided with a low friction surface to facilitate movement of the belt 32 over support 36.

In order to secure a blank 30 on the conveyor belt 32 as it is being transported by the conveyor belt 32 against movement, positive fluid pressure is established on the side of the blank 30 opposite the conveyor belt 32. In the preferred embodiment shown, the fluid pressure is established by means of a head generally designated 40 for conducting and distributing positive fluid pressure, for example air pressure, between one half to four pounds per square inch on the blank 30 on the side thereof opposite belt 32. Air pressure head 40 may have any suitable metal construction including a horizontal portion having a plurality of orifices 42 for discharging air supplied from a blower, compressor or pump schematically shown at 49, a manifold 48 and a plurality of transversely extending chambers 46 which communicate with orifices 42 through means of vertical passages 44.

Chambers 46 extend transversely over the conveyor belt 32 and are connected to air inlets 47 to supply air to a plurality of vertical passages 44 which are spaced from each other along the chamber 46 transversely above the belt 32. Depending on the width of the blank 30 being fed, chamber 46 may be blocked off or partitioned so that only a portion of the orifices 42 are used depending on the width of the blank 30. As shown in FIG. 3, orifices 42 are spaced transversely above and across the conveyor belt 32.

In accordance with the invention, orifices 42 open into pressure chambers 50 respectively as shown in FIG. 3. Pressure chambers 50 are formed in the shown embodiment by elongated grooves in the underside of the head 40 with the grooves 50 extending longitudinally in the direction of travel of the conveyor belt 32 and blank 30. Although not shown, means is provided for adjusting the vertical position of the head 40 relative to the conveyor belt 32 and blank 30 in order to provide a predetermined gap 52 between the bottom surface of the head 40 and the top surface of the blank 30.

Pressure chambers 50 together with the dimension of gap 52 are designed so that the flow of air escaping from between the head 40 and the blank 30 will be restricted and a film of fluid established between the head 40 and the blank 30 to hold the blank 30 against the conveyor belt 32 against movement relative to the conveyor belt and in spaced relation to the head 40. The force generated on the blank 30 from the positive air pressure on its upper surface will be sufficient to maintain the blank 30 against the belt 32 without relative movement therebetween so as to establish registered feeding of the blanks 30. At the same time the air film will prevent the blanks from engaging the head 40.

In one embodiment, the depth of the grooves in the bottom surface of the head 40 which form the chambers 50 is approximately one quarter of an inch while the length of the grooves or chambers 50 is approximately four and one-half inches. In addition the spacing between the chambers 50 is approximately one quarter of an inch. The spacing between the head 40 and the blank is preferably between 0.005 to 0.09 inches.

It will be seen that due to the fact that the escape of air from beneath the head 40 and the upper surface of the blank 30 is restricted, a large source of air pressure is not required thereby saving energy. In addition, due to the film of air which constantly presses against the top side of the blank 30, it is not necessary to time the application or removal of the air pressure but rather the air pressure and film are maintained throughout operation of the machine. In addition, the constant presence of air pressure distributed over the upper surface of the blank 30 will serve to flatten any warped blanks 30 being fed.

Figure 4:
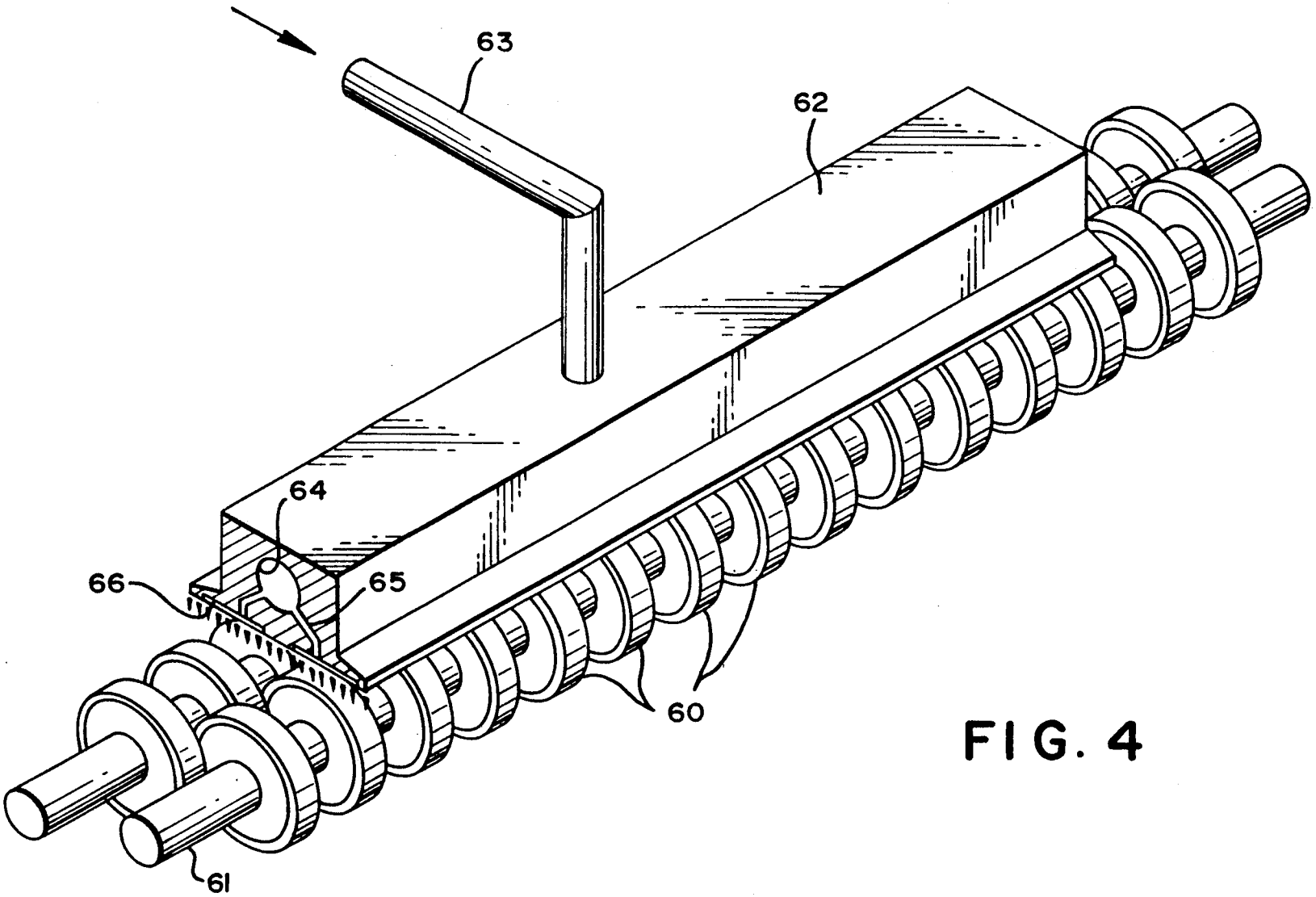
FIG. 4 is a perspective view of a feeder or conveyor system constituting another embodiment of the present invention.
Figure 5:
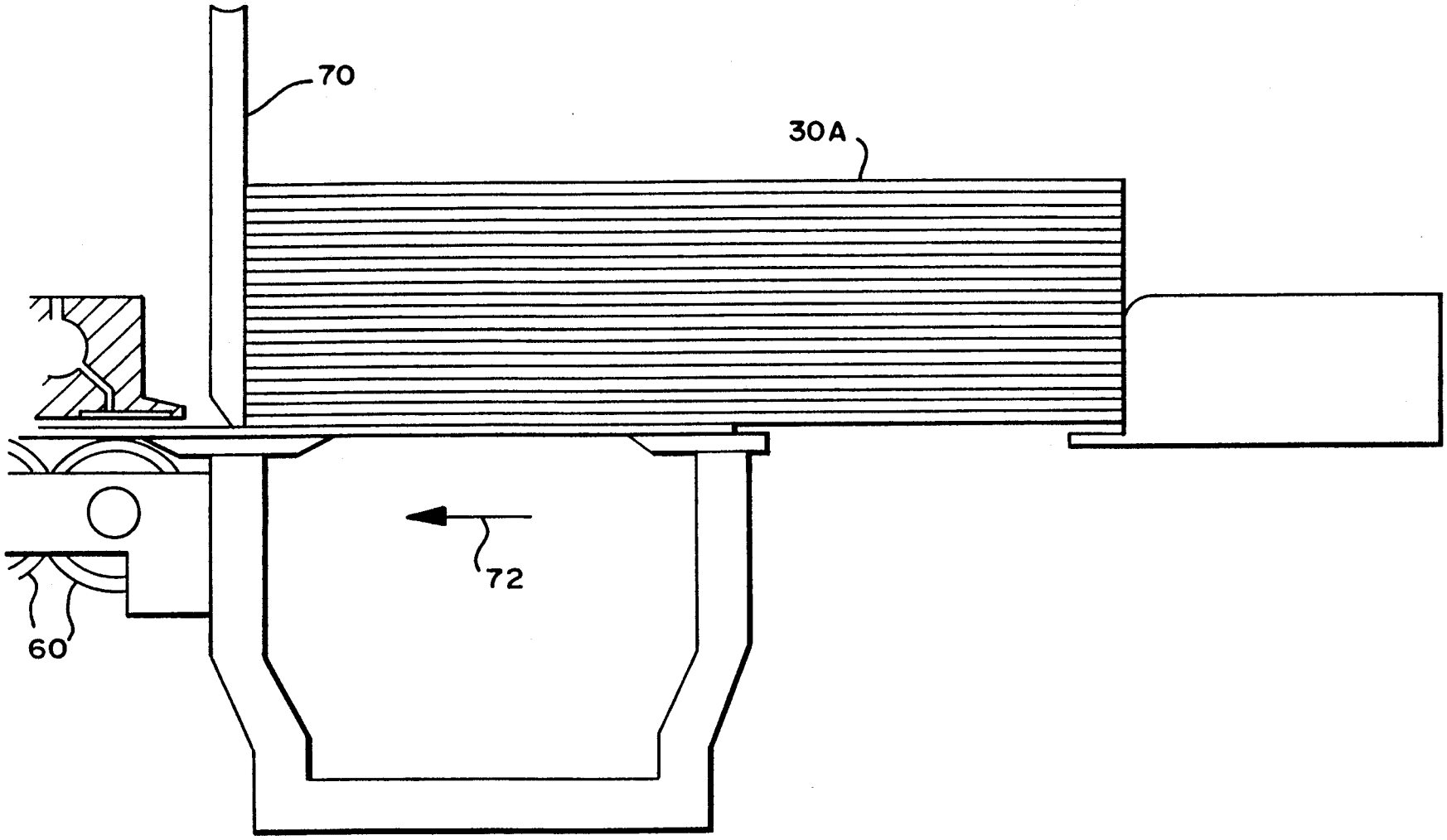
FIG. 5 is an elevational view of the conveyor system shown in FIG. 4 and also showing a supply hopper from where sheets are fed by a feeder (not shown) to the conveyor system.

Instead of using an endless conveyor belt 32 as shown in FIG. 2, any other type of conveyer may be used for example a wheel conveyor shown in FIGS. 4 and 5 by way of example. This conveyor includes a plurality of wheels 60 mounted on shafts 61 to rotate in the direction of conveyor travel 72. The blanks rest on the wheels 60 and are conveyed by the wheels 60 in the direction of conveyor travel. Wheels 60 have a high friction surface. In accordance with the invention, the boards or blanks are held on the wheels 60 by positive fluid pressure provided by a film of air in chambers 66 overlying the upper surfaces of the blanks 30 as shown in FIGS. 4 and 5. Chambers 66 are supplied with air by orifices in the bottom surface of head 62 and communicating with passages 65 which in turn communicate with a central pressure chamber 64 extending transversely of the direction of travel. Air is supplied by any suitable blower, compressor or pump communicating with inlet conduit 63.

FIG. 5 shows the conveyor system of FIG. 4 in combination with a feeding station upstream of the conveyor system where the blanks are stored in a hopper 30A to be conveyed one by one to the conveyor 60,62 by means of any suitable feeder such as disclosed in the patents and pending application identified above. Arrow 72 in FIG. 5 shows the direction blanks 30 are fed from beneath the hopper 30A, the blanks 30 passing under a gate 70 to the conveyor system 60,62 which will then feed the blanks 30 to the first station in an associated machine such as the box finishing machine identified above.

Although the embodiments shown and described have the fluid pressure head (40 or 62) located above the conveyor, the positions may be reversed, however the air pressure head should be on the same side as the printer when receiving sheets therefrom.

It will thus be seen that the present invention does not require as much energy as is required in a vacuum system for drawing the necessary vacuum to hold the blanks on the conveyor. In addition to energy saving, the present invention avoids the noise which results from vacuum blower systems. Furthermore the present invention allows higher forces to be generated for holding the blanks on the conveyor thus ensuring feeding in register. Moreover the upper surface of the board is not engaged by the conveyor system of the present invention to mar printing. In fact the positive air pressure established in accordance with the present invention helps to dry the matter which has been printed on the blanks.

Although specific embodiments of the invention have been shown and described. Other methods and apparatus for establishing a film of fluid or air under pressure above the blanks to hold the blanks against the conveyor may be employed within the scope of the invention. Moreover, it will be understood that the scope of the invention is not limited to the specific embodiments but rather is defined in the appended claims.

What is claimed is:

1. A conveyor system for feeding corrugated blanks in a corrugated box-making machine, the system comprising in combination: conveyor means for transporting the blank along a predetermined path and including a member for holding and moving a blank, means for directing fluid at positive pressure on a side of the blank opposite said member to urge the blank on the member during transport and means for distributing the fluid over substantial surface portions of the blank on said one side thereof to maintain continuous fluid pressure urging the blank on the member and wherein said means for directing fluid pressure includes a head having orifices for discharging fluid and said means for distributing said fluid pressure includes a plurality of chambers in the head respectively communicating with said orifices while being in close but spaced relationship with the blank such that a fluid film is established between the head and the blank to maintain spacing between said head and the blank.

2. The system defined in claim 1 wherein said chambers extend longitudinally generally in the direction of said path.

3. A conveyor system for feeding corrugated blanks in a corrugated box-making machine, the system comprising in combination: conveyor means for transporting the blank along a predetermined path and including a member for holding and moving a blank, means for directing fluid at positive pressure on a side of the blank opposite said member to urge the blank on the member during transport and means for distributing the fluid over substantial surface portions of the blank on said one side thereof to maintain continuous fluid pressure urging the blank on the member and wherein said means for directing fluid pressure includes a head having a plurality of chambers extending generally transversely of said path and a plurality of orifices communicating with each chamber and being spaced from each other in a direction transverse to said path, said head having a surface facing said member and containing said orifices, and wherein said means for distributing the fluid includes a second plurality of chambers received in said surface of the head in communication with said orifices and extending longitudinally of the path.

* * * * *

UNITED STATES PATENT AND TRADEMARK OFFICE

CERTIFICATE OF CORRECTION

PATENT NO. : 5,183,251

DATED : February 2, 1993

INVENTOR(S) : LOUIS M. SARDELLA

It is certified that error appears in the above-identified patent and that said Letters Patent is hereby corrected as shown below:

On the title page, item [54] and in column 1, line 2, in the Title, before "FEEDING", delete "AND" and insert -- FOR --.

Signed and Sealed this

Ninth Day of November, 1993

Bruce Lehman

*Attest:*

BRUCE LEHMAN

*Attesting Officer*

*Commissioner of Patents and Trademarks*